US006842101B2

(12) United States Patent
Maguire et al.

(10) Patent No.: US 6,842,101 B2
(45) Date of Patent: Jan. 11, 2005

(54) TUNABLE INDUCTOR

(75) Inventors: Joseph N. Maguire, Syracuse, NY (US); Joseph A. Zennamo, Jr., Skaneateles, NY (US)

(73) Assignee: Eagle Comtronics, Inc., Clay, NY (US)

( * ) Notice: Subject to any disclaimer, the term of this patent is extended or adjusted under 35 U.S.C. 154(b) by 186 days.

(21) Appl. No.: 10/061,390

(22) Filed: Feb. 1, 2002

(65) Prior Publication Data

US 2003/0128092 A1 Jul. 10, 2003

Related U.S. Application Data

(60) Provisional application No. 60/346,822, filed on Jan. 8, 2002.

(51) Int. Cl.[7] ..... H01F 27/30
(52) U.S. Cl. ..... 336/198; 336/192
(58) Field of Search ..... 336/65, 136, 192, 336/198, 205

(56) References Cited

U.S. PATENT DOCUMENTS

| | | | | |
|---|---|---|---|---|
| 2,751,563 A | * | 6/1956 | Willyard et al. | 336/65 |
| 2,941,172 A | * | 6/1960 | Sutton, Jr. | 336/92 |
| 3,649,939 A | * | 3/1972 | Hildebrandt | 336/65 |
| 4,109,224 A | * | 8/1978 | Liautaud | 336/192 |
| 4,170,014 A | * | 10/1979 | Sully | 343/749 |
| 4,229,722 A | * | 10/1980 | Olsen | 336/192 |
| 4,255,735 A | * | 3/1981 | Liautaud | 336/192 |

OTHER PUBLICATIONS

Drawings of Eagle Comtronics Inductor (2 pages), before Jan., 2001.

Drawing of Goguen Industries, Inc. Inductor (1 page), Jan. 1, 1992.

Specification sheet of Standex Electronics, 7mm Variable Inductors, Series 800, 126 & 936 (1 page), before Jan., 2001.

Specification sheet of Coilcraft, Tunable RF Coils (1 page), before, Jan., 2001.

Specification sheet of Coilcraft, "Slot Ten" 10 mm Tunable RF coils (1 page), before Jan., 2001.

Specification sheet of Coilcraft, "Slot Seven" 7 mm Tunable RF coils (1 page), before Jan., 2001.

Specification sheet of TOKO,Type MC117, Molded Coils (1 page), before Jan., 2001.

Specification sheet of TOKO,Type MC119, Molded Coils (1 page), before Jan., 2001.

Specification sheet of TOKO,Type MC152, Molded Coils for Surface Mounting (2 pages), before Jan., 2001.

* cited by examiner

*Primary Examiner*—Tuyen T. Nguyen
(74) *Attorney, Agent, or Firm*—Burr & Brown

(57) ABSTRACT

A tunable inductor is provided, including an elongate mandrel having a central axis, and having a helical groove of predetermined pitch formed on an outer surface thereof. A flange having at least one guide member is also included proximate a first end of the mandrel and positioned substantially perpendicular the central axis thereof. A wire is also included, positioned within the helical groove and wound about the central axis of the mandrel, as well as a turn member positioned a distance from the flange in the axial direction and protruding from the outer surface of the mandrel. The turn member is radially offset from one guide member by an amount substantially equal to a diameter of the wire, and redirects the wire in a direction substantially parallel to the central axis of the mandrel from the helical groove back toward the first end of the mandrel.

49 Claims, 4 Drawing Sheets

TUNABLE INDUCTOR

CROSS REFERENCE TO RELATED APPLICATION

This application claims the benefit of U.S. Provisional Patent Application No. 60/346,822, filed Jan. 8, 2002, the entirety of which is incorporated herein by reference.

FIELD OF THE INVENTION

The present invention relates generally to wound inductor coils, and particularly to tunable inductor coils used in high frequency electronic products such as electronic filters (e.g., filters used in CATV systems).

BACKGROUND OF THE INVENTION

Inductors are typically included among the discrete electronic components used in the circuit assemblies for electronic filters, such as notch filters and traps used in CATV systems. For these types of applications, it is particularly important that the inductors be tunable to the desired frequencies to be blocked or trapped by the filter.

It is known to use inductors which are free-floating, air-wound coils of wire having a predetermined number of turns. The inductance value of each coil is determined by the coil diameter, the number of turns, the distance between the wire turns, and the gage and length of the wire. Distortions present in th e coil also affect the inductance value.

The inductance value plays a role with respect to the overall circuit in that the coils are used to compensate for variations in other electrical components of the circuit, such as capacitive tolerances which can range from 2–5%. In that manner, inductor coils having a reliable natural frequency are desired to compensate for such variations. In order to obtain the desired natural frequency, the coils are subjected to a pre-alignment process wherein the coils are manually stretched such that each turn of the wire is separated from adjacent turns of the wire. The quality factor (Q) of the coil is highest when the diameter of the wire divided by the spacing between adjacent turns of the wire ranges from about 0.6 to 0.9.

There are several drawbacks associated with known inductors with respect to the structure, positioning, stretching and tuning thereof, and substantial room for improvement exists.

One problem is that numerous process steps are required to use air-wound coils in filter assemblies. First, an air-wound coil is positioned on a circuit board along with other discrete components for the circuit, and then the entire panel (i.e., circuit board array) is wave soldered. Next, the individual circuit boards are singulated from the panel. A screw guide is then added to each coil, and the coils are then manually stretched to a natural frequency to compensate for variations in the other electronic components. The circuit board is then positioned in a filter housing, which is subsequently potted before tuning slugs are inserted and screwed into the screw guides to manually tune each inductor.

Another problem is the human error factor associated with manually stretching the coils. That is, variations in human performance increase the difficulty of obtaining the desired pitch between adjacent wires when stretching the coils and often result in undesirable variations between coil units. For example, there can be a wide fluctuation in the actual Q (quality factor) of the coil due to the way the coil is stretched.

Additionally, excess flux used during the wave soldering step can migrate to the coils and effectively adhere the coil windings together. This adhesion makes it nearly impossible to stretch the coil to achieve the desired pitch during the coil stretching step of the pre-alignment process.

Yet another problem is that the coils themselves must be positioned on the circuit board without incurring distortions that affect the inductance value. For example, manual stretching and tuning may displace the coils laterally along the circuit board. This is undesirable because leaning coils will change the magnetic coupling therebetween and reduce the operating efficiency of the circuit. Further, any distortions or displacements along the length of the lead wire extending from the wound portion of the coil can also adversely affect performance and Q.

It would be desirable to provide tunable inductor coils that exhibit consistent Q and inductance values from unit to unit. It would also be desirable to provide inductor coils that do not need to be manually stretched for pre-alignment purposes, and which can structurally withstand handling during manufacturing.

SUMMARY OF THE INVENTION

It is an object of the present invention to overcome the drawbacks of the prior art. Particularly, it is an object of the present invention to provide a tunable inductor coil having a predetermined inductance value and having consistent inductance values and Q values from unit to unit.

It is a further object of the present invention to provide a pre-assembled tunable inductor coil which does not require manual stretching of the coil to achieve desired inductance and Q values, and which can structurally withstand handling during manufacturing.

in accordance with one embodiment of the present invention, a tunable inductor is provided, including an elongate mandrel having a central axis, a first end, an opposed second end, an outer surface and an inner surface defining an inner cavity. The mandrel also includes a helical groove of predetermined pitch formed on the outer surface thereof, and extending in an axial direction from the first end toward the second end. The mandrel also includes a flange proximate the first end and positioned substantially perpendicular to the central axis thereof. The flange includes at least one guide member. A wire having a diameter, a first end and a second end is also provided, positioned within the helical groove of the mandrel and wound about the central axis thereof. The mandrel also includes a turn member positioned a distance from the flange in the axial direction.

The turn member protrudes from the outer surface of the mandrel, preferably in a direction substantially perpendicular to the central axis of the mandrel, and is radially offset from the guide member by an amount substantially equal to the diameter of the wire. Preferably, the pitch of the helical groove is also substantially equal to the diameter of the wire. The turn member redirects the wire in a direction substantially parallel to the outer surface of the mandrel from the helical groove back toward the first end of the mandrel proximate the at least one guide member of the flange.

Preferably, the flange includes a first portion having a first guide member formed as a through-hole, and a second portion having a second guide member formed as a substantially U-shaped groove. The wire would start in the through-hole, pass along the helical groove, over the turn member and then be secured in the U-shaped groove.

The present invention ultimately provides a pre-wound inductor coil having a predetermined number of turns based on the desired inductance value. That is, a naked mandrel (e.g., without wire wound thereon to form the finished inductor) according to the present invention is formed according to known molding techniques, such as injection molding, and provides a skeletal support structure for the wire which determines the inductance behavior of the finished product. The mandrel is preferably formed of a plastic material, including but not limited to thermoplastic polyester. Each mold includes the precise dimensions for the distance between the turns of the helical groove, the number of turns, and the position of the turning member proximate the terminal end of the helical groove according to the desired number of turns. Different molds are used to provide mandrels for coils of different inductance values. However, according to the present invention, the overall axial dimension of the mandrel may remain constant while the number of turns of the helical groove and the axial height of the turn members are varied to provide different inductance values.

Because the helical groove is dimensioned and formed when the mandrel is molded, the distance between the turns can be controlled in accord with the gage of the wire to be used to obtain the desired natural frequency of the resultant coil. And since the turn member is also positioned axially when the mandrel is initially formed, its position with respect to the number of turns further ensures the desired inductance characteristics. The helical groove can extend to the top of the mandrel, or alternately, the groove can terminate proximate the turning post. In the case where the helical groove extends to the top of the mandrel, the position of the turning post will interrupt the helical groove and ultimately determine the number of turns of the coil.

The present invention offers many benefits over the prior art. First, the pre-formed mandrel is designed to automatically provide the desired natural frequency for a given inductor when the wire is wound thereon, which eliminates the need to manually stretch the coil to meet that objective.

Second, the mandrel skeleton helps retain the position of the wire and provides rigidity for the coil once the wire is properly wound within the precisely dimensioned turns of the helical groove. In that manner, the coil is not subject to physical distortions which alter the inductance and Q values of the inductor.

Third, the inductance and Q values for inductors of the present invention are highly consistent and reproducible from unit to unit, and the human error associated with manually stretching the coils is virtually eliminated.

Fourth, the number of manufacturing steps associated with the present invention is significantly reduced from the number associated with the prior methods. That is, once the pre-fabricated inductor coil/mandrel unit is positioned on the circuit board, all of the steps between wave soldering and tuning are eliminated.

Fifth, using the tunable inductor of the present invention offers a 10–15% savings margin over the manufacturing cost presently associated with electronic filters.

According to another embodiment of the present invention, an electronic filter is provided that includes at least one of the tunable inductors described above. In this case, it is also preferred that the inductor coil include at least one anti-rotation member having a predetermined shape proximate the first end of the mandrel and positioned beneath the flange. The circuit board of the filter would also be structured to have at least one opening passing from the first surface to the second surface thereof, and that opening would be shaped to compliment the predetermined shape of the anti-rotation member to prevent the inductor from rotating with respect to the circuit board.

According to another embodiment of the present invention, a tunable inductor is provided including an elongate mandrel having a central axis, a first end, an opposed second end, an outer surface and an inner surface defining an inner cavity. The inductor also includes a flange proximate the first end of the mandrel and positioned substantially perpendicular to the central axis of the mandrel, and a wire having a diameter, a first end and a second end, the wire being wound about the outer surface of the mandrel from a position proximate the first end of the mandrel toward the second end of the mandrel. A turn member is also provided, positioned a distance from the flange in the axial direction of the mandrel and protruding from the outer surface of the mandrel, wherein the turn member redirects the wire in a direction substantially parallel to the outer surface of the mandrel back toward the first end of the mandrel. Means for maintaining the position of the wire with respect to the mandrel are also included.

Preferably, the means for maintaining the position of the wire with respect to the mandrel includes at least one layer of an electrically insulating material covering substantially all of the wire wound on the mandrel. It is also preferred to include a second layer of an electrically insulating material covering the first layer and that portion of the wire being redirected from the turn member in a direction substantially parallel to the outer surface of the mandrel back toward the first end of the mandrel. If, however, the wire itself is coated with an insulating material, the means for maintaining the position of the wire with respect to the mandrel need only include the above second layer of an electrically insulating material.

According to yet another embodiment of the present invention, a tunable inductor is provided, including an elongate mandrel extending in a first direction from a first end toward an opposed second end and having a central axis, an outer surface and an inner surface defining an inner cavity. A flange is provided proximate the first end of the mandrel and positioned substantially perpendicular to the central axis of the mandrel. The flange includes a first surface and an opposed second surface adapted to rest on a surface of a circuit board. The inductor also includes an extension member extending beyond the flange in a second direction substantially opposite to the first direction. The extension member includes an outer surface and an inner surface that is substantially contiguous with the inner surface of the mandrel to define an extension of the inner cavity of the mandrel. A wire having a diameter, a first end and a second end is also provided, wound about the outer surface of the mandrel from a position proximate the first end of the mandrel toward the second end of the mandrel. A tuning member having an initial position located within the inner cavity of the extension beyond a flux field created by the wire wound on the mandrel is also provided such that the tuning member in the initial position does not substantially affect the inductance of the inductor. Preferably, the tuning member does not substantially extend beyond the flange.

It is also preferred that the flange further includes first and second guide members for receiving portions of the wire proximate first and second ends of the wire, and at least one stepped portion positioned proximate each of the first and the second guide members on the second surface. The at least one stepped portion should be dimensioned to receive a portion of the wire extending through a respective one of the first and the second guide members such that the wire does not extend from the at least one stepped portion beyond the plane of the second surface of the flange. In this case, it is further preferred that the at least one stepped portion positioned proximate the first guide member redirects the wire in a third direction substantially perpendicular to the outer surface of the mandrel, and the at least one stepped portion positioned proximate the second guide member redirects the wire in a fourth direction substantially perpendicular to the outer surface of the mandrel and substantially opposing the third direction.

According to yet another embodiment of the present invention, a method of making a tunable inductor having a predetermined inductance value is provided. The method includes a step of providing an elongate mandrel having a central axis, a first end, an opposed second end, an outer surface, an inner surface defining an inner cavity, and a flange proximate the first end and arranged substantially perpendicular to the central axis of the mandrel. The flange has a first portion having a first guide member and a second portion having a second guide member. The mandrel further includes a helical groove of predetermined pitch formed on the outer surface and extending in a direction from the first end toward the second end. The method also includes the steps of positioning a turn member protruding from the outer surface of the mandrel at a predetermined axial distance from the flange, positioning a first end section of a wire in one of the first and second guide members, and winding the wire in the helical groove to a position proximate the turn member. Further, the method includes the steps of bendably positioning the wire about the turning member to redirect the wire back toward the flange in a direction substantially parallel to the outer surface of the mandrel, and positioning a second end section of the wire in the other one of the first and the second guide members. Ultimately, the position of the turn member determines the inductance value of the inductor.

BRIEF DESCRIPTION OF THE DRAWINGS

For a more complete understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
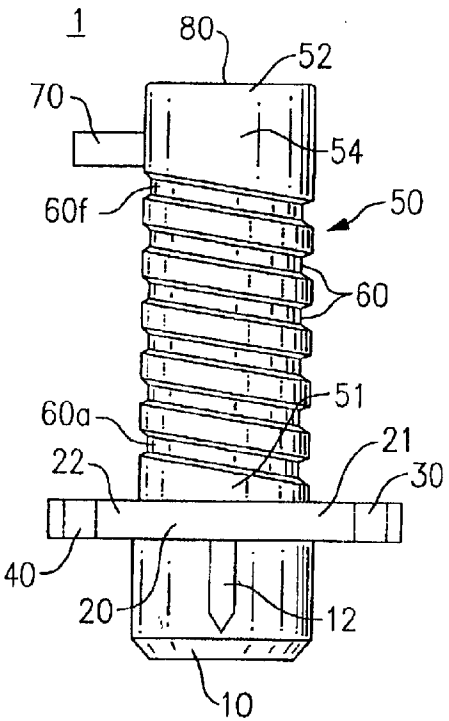
FIG. 1 is a side view of a mandrel for a tunable inductor according to one embodiment of the present invention.

FIG. 1 is a side view of a mandrel for a tunable inductor according to one embodiment of the present invention. The mandrel 1 extends from a chamfered first end 10 toward an opposed second end 80 in an axial direction. The second end 80 is preferably a closed surface to facilitate automated handling and prevent the introduction of contaminants during manufacturing. As shown, the chamfered first end 10 corresponds to an extension of the mandrel and includes first and second tapered anti-rotation members 11 (see FIG. 2A) and 12 projecting from the outer surface on opposing sides thereof, radially spaced approximately 180° apart.

The mandrel 1 also includes a flange 20 having a first portion 21 and a second portion 22. The first portion 21 includes a first guide member 30 formed as a through-hole therein, and the second portion 22 includes a second guide member 40 formed as a substantially U-shaped groove therein. As shown, the first and second guide members 30 and 40 are spaced approximately 180° apart, and each guide member is radially spaced approximately 90° from the first and second anti-rotation members 11 and 12.

An elongate portion 50 having a first end 51 and an opposed second end 52 (which corresponds to the second end 80 of the mandrel 1) is also included. The elongate portion 50 is positioned substantially perpendicular to the flange 20 and extends therefrom in the axial direction of the mandrel 1. The elongate portion 50 further includes a helical groove 60 formed on the outer surface 54 thereof.

As shown, the helical groove 60 begins proximate the first end 51 of the mandrel and extends toward the second end 52 over 6 turns 60*a* to 60*f*. The distance between each turn of the helical groove 60 is dimensioned to be substantially the same as the diameter, d, of a wire 90 wound therein (see FIG. 2A). The helical groove 60 terminates at a position proximate a turn member 70, which protrudes from the elongate portion 50 substantially perpendicularly with respect to the central axis of the mandrel 1.

Figure 2B:
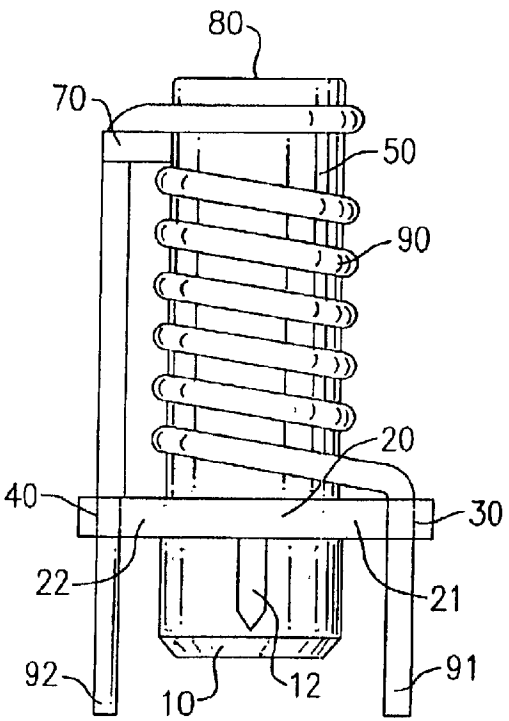
FIG. 2B is a side view of the mandrel/wire assembly of FIG. 2A.
Figure 2A:
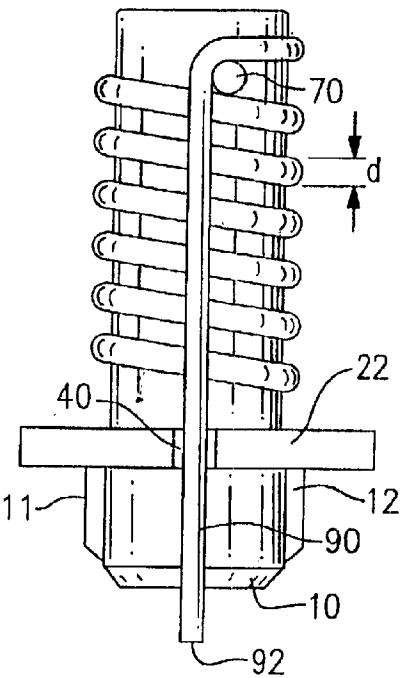
FIG. 2A is a front view of the mandrel shown in FIG. 1 rotated 90° and having a wire wound thereon according to one embodiment of the present invention.

FIG. 2A is a front view of the mandrel 1 shown in FIG. 1 (rotated 90°), further including wire 90 wound thereon. FIG. 2A is best understood when read in conjunction with FIG. 2B, which is a side view of the mandrel/wire assembly shown in FIG. 2A. The wire 90 is dimensioned to have a diameter, d, and includes a first end section 91 and a second end section 92. The wire 90 is wound about the elongate portion 50 of the mandrel 1 within the turns of the helical groove 60. The wire can be made of any suitable conductor (e.g., tinned or non-tinned copper magnetic wire).

The first end section 91 is fed through the first guide member 30 and another portion of the wire 90 is wound about the central axis on the outer surface of the elongate portion 50 within the helical groove 60. Proximate the second end 52 of the elongate portion 50, the wire 90 is bendably positioned about the turn member 70, which redirects the wire (in a direction substantially parallel to the outer surface of the mandrel 1) back toward the second portion 22 of the flange 20, where the second end section 92 is positioned in the U-shaped groove of the second guide member 40. When the winding of the wire 90 is complete as shown, the first end section 91 extends downwardly from the first guide member 30 in the first flange portion 21, and the second end section 92 extends downwardly from the second guide member 40 in the second flange portion 22.

Figure 3B:
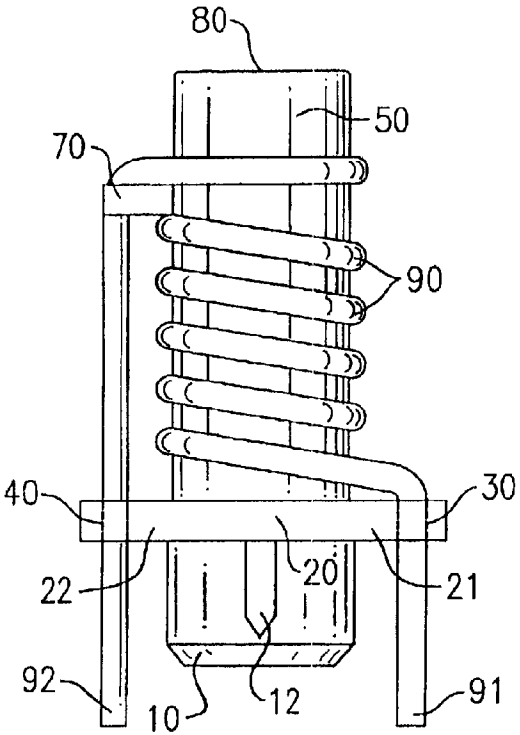
FIG. 3B is a side view of the mandrel/wire assembly of FIG. 3A.
Figure 3A:
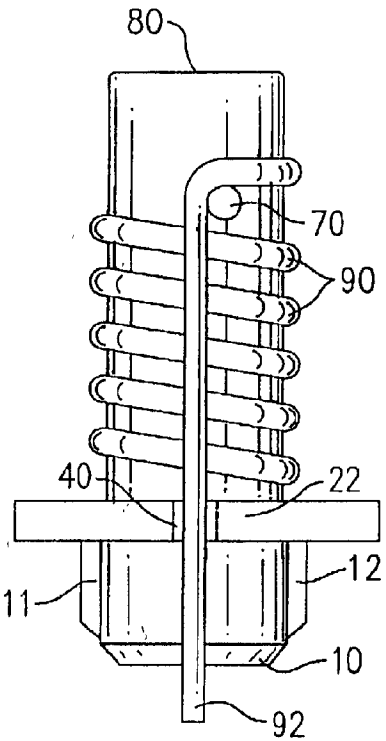
FIG. 3A is a front view of the mandrel for a tunable inductor shown in FIG. 1 and having a wire wound thereon according to another embodiment of the present invention.

FIG. 3A is a front view of a mandrel having wire wound thereon according to another embodiment of the present invention, and FIG. 3B is a side view of the inductor shown in FIG. 3A. Although the length of the elongate portion 50 of the mandrel 1 is the same as that shown in FIGS. 1, 2A and 2B, the position of the turn member 70 is varied in FIGS. 3A and 3B. Accordingly, the number of turns of the helical groove is also varied. For example, the helical groove 60 in the mandrel in FIGS. 1, 2A and 2B includes 6 turns before terminating proximate the turning post 70, whereas the helical groove in the mandrel in FIGS. 3A and 3B includes only 5 turns. Although it is not shown in the drawings, the helical groove can instead extend to a position proximate the top (i.e., the second end 80) of the mandrel.

The turning post 70 can be positioned at varied locations along the elongate portion of the mandrel in the axial direction by providing different molds having a post forming part positioned at different distances from the flange 20. While the length of the mandrel and the number of turns in the helical groove may remain constant among the molds, the varied position of the turning post interrupts the helical groove at that point and essentially terminates the viable number of turns for that coil. In that case, the inductance value of the inductor is controlled by virtue of the position of the turn member 70 and the corresponding number of turns of the wire rather than the overall number of turns in the groove itself.

Figure 4:
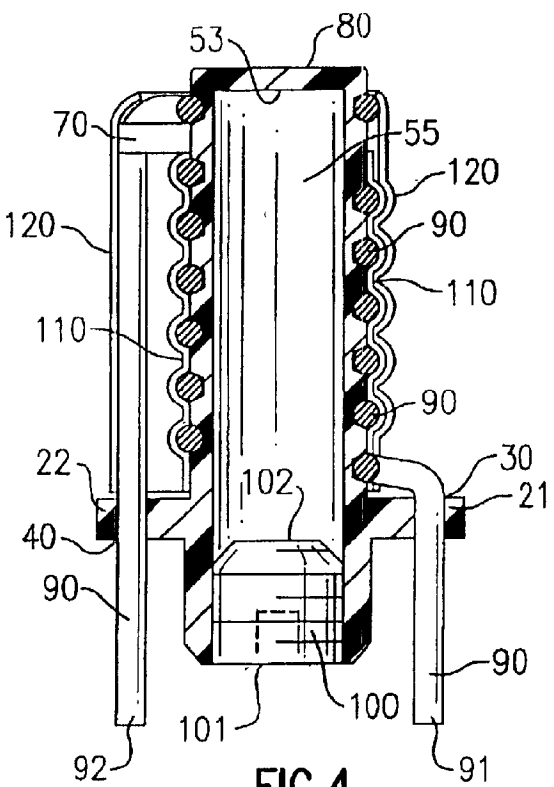
FIG. 4 is a partial cross-sectional view of the inductor shown in FIG. 2B.

FIG. 4 is a partial cross-sectional view of the inductor shown in FIG. 2B. In this view, the inner cavity 55 of the mandrel 1 is shown, having an inner surface 53 and an outer surface 54 on which the helical groove 60 is formed. In cross-section, the helical groove 60 is seen as substantially semi-circular sections representing turns 60*a* to 60*f*. The cross-sectional shape is not critical, and can be of any shape (e.g., a truncated "V"). As shown, each cross-sectional portion of the helical groove 60 houses a circular cross-section of the wire 90.

A tuning slug 100 having a first end 101 and an opposed second end 102 is positioned within an extended portion of the inner cavity 55 proximate the chamfered first end 10 of the mandrel 1. As mentioned above, the chamfered first end 10 corresponds to an extension member extending below the flange 20. The inner surface of the extension member is substantially contiguous with the inner surface 53 of the elongate portion 50 of the mandrel to define an extended inner cavity 55 of the mandrel. The tuning slug 100 is fitted with an adjustment member proximate the first end 101 for adjusting its axial position within the inner cavity 55. The position of the tuning slug 100 is adjusted to further control the inductance of the coil as is known in the art.

FIG. 4 also shows a first layer of electrically insulating material 110 substantially covering all of the wire 90 wound on the elongate portion 50 and residing within the helical groove 60. The electrically insulating material layer 110 is used to prevent the inductor from shorting out between the turns of the wire 90 in the helical groove 60 and the redirected portion of the wire 90 running parallel to the outer surface of the mandrel. This is especially important when the wire 90 is not itself coated with an electrically insulating material. However, the wire 90 can also be provided with an electrically insulating coating material on the outer surface thereof.

Additionally, a heat-shrink material layer 120 is provided, which substantially surrounds the length of the wire-wound elongate portion 50 of the mandrel up to and to the position of the turning member 70. The heat-shrink layer 120 also surrounds the redirected portion of the wire 90 extending between the turn member 70 and the second guide member 40. The layer 120 overlays the layer 110, and further secures the position of the wire 90 with respect to the helical groove 60. The heat-shrink layer also secures the position of the redirected portion of the wire 90 extending parallel to the outer surface of the mandrel from the turn member 70 to the second guide member 40.

Figure 5:
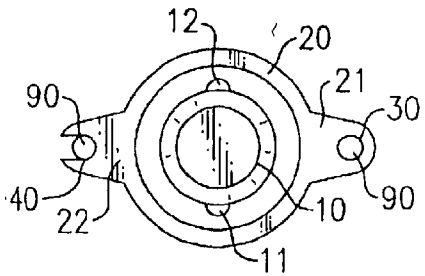
FIG. 5 is a bottom view of the inductor shown in FIG. 2B.

FIG. 5 is a bottom view of the inductor shown in FIG. 2B. The flange 20 includes the first portion 21 having the first guide member 30 formed as a through-hole therein. The second portion 22 opposes the first portion 21 and includes the second guide member 40 formed as a U-shaped groove therein. A bottom portion of the first end 10 of the mandrel (see FIG. 2B) can also be seen, including the two opposed anti-rotation members 11 and 12. As shown, the position of the first anti-rotation member 11 is spaced approximately 90° from the first portion 21 of the flange 20, and the position of the second anti-rotation member 12 is spaced approximately 90° from the second portion 22 of the flange 20. In that manner, the first and second anti-rotation members 11 and 12 are spaced approximately 180° from one another.

Figure 6:
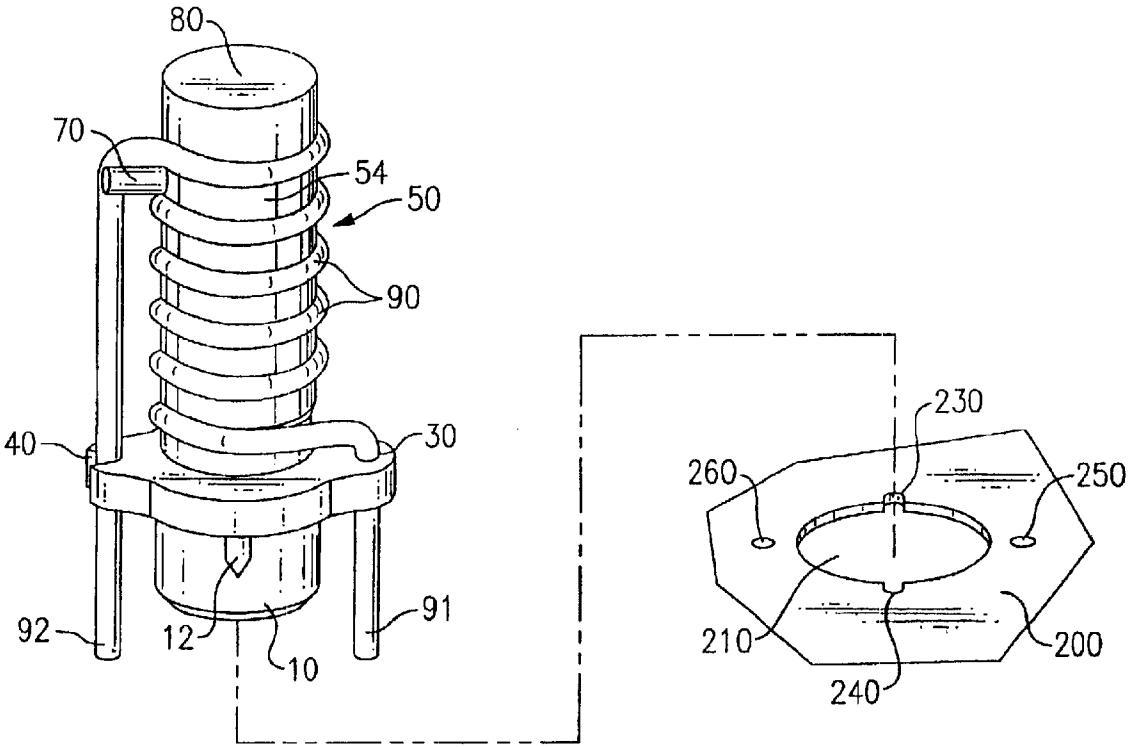
FIG. 6 is a perspective view of a tunable inductor and a circuit board for an electronic filter shaped to accommodate the tunable inductor according to one embodiment of the present invention.

FIG. 6 is a perspective view of a tunable inductor and a circuit board 200 for an electronic filter having a hole 210 shaped to accommodate a tunable inductor according to the present invention. The hole 210 includes a first portion 220 having a diameter dimensioned to accept the major diameter of first chamfered end 10 of the mandrel 1 shown in FIG. 1. The hole 210 also includes first and second notches 230 and 240 shaped to correspond to the first and second anti-rotation members 11 and 12 (see FIG. 2A). As shown, the first notch 230 is located proximate the 12 o'clock position of the first portion 220 of the hole 210, and the second notch 240 is located proximate the 6 o'clock position of the first portion 220 of the hole 210. In this manner, the first and second notches 230 and 240 are approximately 180° apart with respect to the first portion 220 of the hole 210. When the inductor is properly positioned within the receptor hole 210, the anti-rotation members 11 and 12 are keyed to the notches 230 and 240 such that the inductor will not be allowed to rotate with respect to the circuit board.

Further, the circuit board 200 includes a first lead hole 250 located proximate the 3 o'clock position of the first portion 220 of the receptor hole 210, approximately 90° from the position of both the first and second notches 230 and 240. The circuit board 200 also includes a second lead hole 260 located proximate the 9 o'clock position of the first portion 220 of the receptor hole 210, approximately 90° from the position of both the first and second notches 230 and 240. In that manner, the first and second lead holes 250 and 260 are approximately 180° apart with respect to the first portion 220 of the receptor hole 210. As shown, the first end 91 of the wire 90 will extend through the first lead hole 250 when the inductor is positioned on the circuit board 200. Similarly, the second end 92 of the wire 90 will extend through the second lead hole 260.

Figure 7:
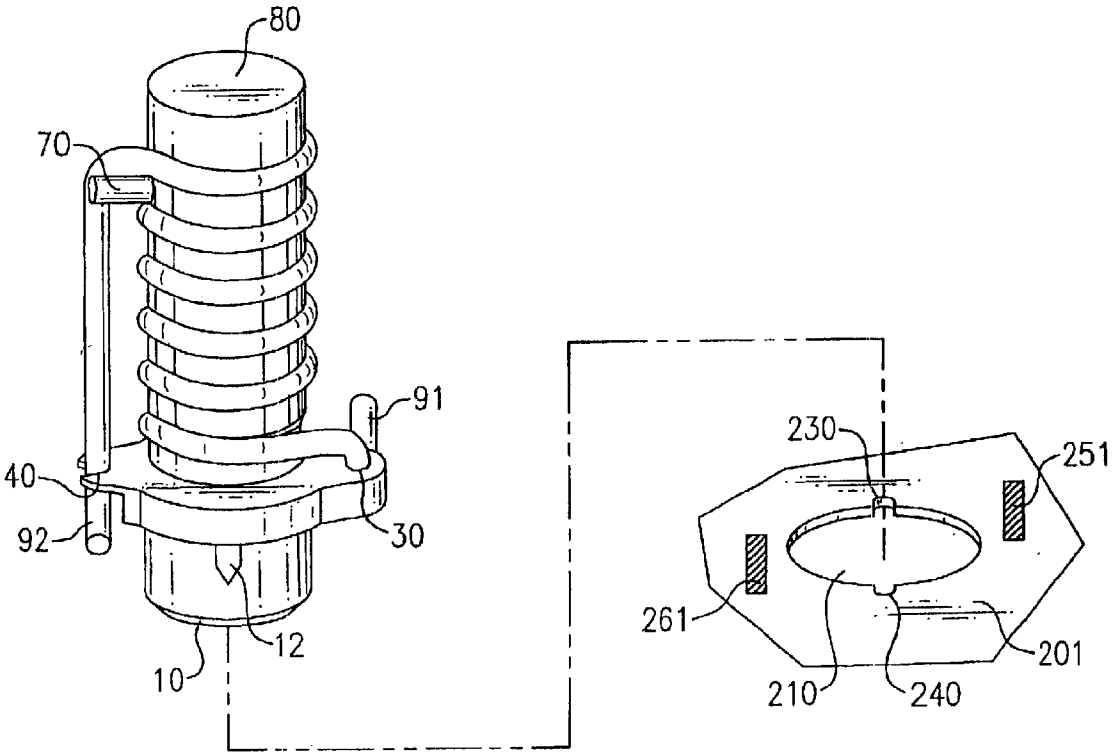
FIG. 7 is a perspective view of a tunable inductor and a circuit board for an electronic filter shaped to accommodate the tunable inductor by surface mounting according to another embodiment of the present invention.
Figure 8:
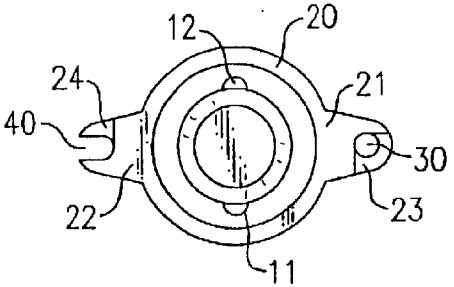
FIG. 8 is a bottom view of the tunable inductor shown in FIG. 7 (without the wire 90).

In an alternate embodiment of the present invention shown in FIGS. 7 and 8, a section of the first portion 21 of the flange 20 and a section of the second portion 22 of the flange 20 is removed to form respective stepped portions 23 and 24. As shown, the first end 91 of the wire 90 is bendably positioned and received within the stepped portion 23 rather than being positioned to extend downwardly from the first guide member 30 as shown in FIG. 6. Similarly, the second end 92 of the wire 90 is bendably positioned and received within the stepped portion 24 rather than being positioned to extend downwardly from the second guide member 40. In that manner, each of the first and second ends 91 and 92 of the wire 90 extend in opposite directions, each direction being substantially perpendicular to the outer surface of the mandrel.

This arrangement promotes stability of the inductor when positioned with respect to a circuit board (described below) and facilitates surface mounting of the tunable inductor.

First, the redirected ends of the wire extending beyond the guide members provide surface contact with the circuit board on which the inductor is positioned. Second, because portions of the ends of the wire extending through the respective guide members reside within the above-described stepped portions 23 and 24, the redirected ends do not substantially extend beyond the plane of the flange. This way, the flange effectively retains its ability to rest on the surface of a circuit board without substantial disruption from the wire extensions. Third, because the respective redirected ends of the wire extend in opposite directions substantially along the plane of the circuit board, the redirected portions provide stability by functioning as balancing feet.

The circuit board 201 shown in FIG. 7 is similar to the one shown and described in conjunction with FIG. 6, however some differences warrant mention. For example, where the circuit board 200 in FIG. 6 shows first and second lead holes 250 and 260 positioned to accept and direct the end portions 91 and 92 of the wire into the circuit board, the circuit board 201 in FIG. 7 includes conductive contact pads 251 and 261 corresponding to the positions of the redirected end portions 91 and 92 of the wire. In this case, instead of being positioned substantially perpendicular to and passing through the circuit board, the redirected ends of the wires are positioned along the plane of the circuit board (i.e., substantially parallel thereto) as mentioned above. When the inductor/circuit board assembly is wave soldered, the contact pads and the redirected portions of the wire are soldered at the point of contact therebetween to securely mount the inductor to the circuit board.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. A tunable inductor comprising:

an elongate mandrel having a central axis, a first end, an opposed second end, an outer surface and an inner surface defining an inner cavity, and having a helical groove of predetermined pitch formed on said outer surface and extending in a direction from said first end toward said second end;

a flange proximate said first end of said mandrel and positioned substantially perpendicular to said central axis of said mandrel, said flange having at least one guide member;

a wire having a diameter, a first end and a second end, said wire being positioned within said helical groove of said mandrel and wound about said outer surface of said mandrel; and a turn member positioned a distance from said flange in the axial direction of said mandrel and protruding from said outer surface of said mandrel, said turn member being radially offset from one of said at least one guide member by an amount substantially equal to said diameter of said wire;

wherein said turn member redirects said wire in a direction substantially parallel to said outer surface of said mandrel from said helical groove back toward said first end of said mandrel.

2. The inductor of claim 1, wherein said flange comprises a first portion having a first guide member and a second portion having a second guide member.

3. The inductor of claim 2, wherein said first guide member is formed as a through-hole in said first portion of said flange, and said second guide member is formed as a substantially U-shaped groove in said second portion of said flange.

4. The inductor of claim 2, wherein said wire starts in one of said first and said second guide members and ends in the other guide member.

5. The inductor of claim 3, wherein said wire starts in said first guide member and ends in said second guide member.

6. The inductor of claim 1, wherein said helical groove begins at a position proximate said first end of said mandrel and extends toward said second end over a predetermined distance along said central axis of said mandrel.

7. The inductor of claim 1, further comprising a tuning member positioned within said inner cavity of said mandrel.

8. The inductor of claim 1, wherein said wire is coated with an insulating material.

9. The inductor of claim 8, further comprising at least one layer of an electrically insulating material surrounding substantially all of said outer surface of said elongate mandrel, including the entire portion thereof over which said wire is wound and including the portion of said wire being redirected from said turn member in a direction substantially parallel to said central axis of said mandrel back toward said first end of said mandrel.

10. The inductor of claim 1, further comprising at least one layer of insulating material covering substantially all of said wire residing within said helical groove.

11. The inductor of claim 10, further comprising a second layer of an electrically insulating material covering said first layer and that portion of said wire being redirected from said turn member in a direction substantially parallel to said central axis of said mandrel back toward said first end of said mandrel.

12. The inductor of claim 1, further comprising at least one anti-rotation member proximate said first end of said mandrel and positioned beneath said flange.

13. The inductor of claim 1, wherein said pitch of said helical groove is substantially equal to said diameter of said wire.

14. The inductor of claim 1, wherein said turn member protrudes from said outer surface of said mandrel in a direction substantially perpendicular to the central axis of said mandrel.

15. A tunable inductor comprising:

an elongate mandrel having a central axis, a first end, an opposed second end, an outer surface and an inner surface defining an inner cavity, and having a helical groove of predetermined pitch formed on said outer surface and extending in a direction from said first end toward said second end;

a wire having a diameter, a first end and a second end, said wire being positioned within said helical groove of said mandrel and wound about said central axis of said mandrel; and a turn member protruding from said outer surface of said mandrel for redirecting said wire from said helical groove back toward said first end of said mandrel in a direction substantially parallel to said outer surface of said mandrel.

16. The inductor of claim 15, further comprising a flange proximate said first end of said mandrel and positioned substantially perpendicular to said central axis of said mandrel, said flange having at least one guide member.

17. The inductor of claim 15, wherein said turn member is positioned a predetermined distance from said flange in the axial direction of said mandrel.

18. The inductor of claim 16, wherein said turn member is radially offset from said at least one said guide member by an amount substantially equal to said diameter of said wire.

19. The inductor of claim 15, wherein said helical groove begins at a position proximate said first end of said mandrel and extends toward said second end over a predetermined distance along said central axis of said mandrel.

20. The inductor of claim 16, further comprising at least one anti-rotation member proximate said first end of said mandrel and positioned beneath said flange.

21. The inductor of claim 15, wherein said pitch of said helical groove is substantially equal to said diameter of said wire.

22. The inductor of claim 16, wherein said flange comprises a first portion having a first guide member and a second portion having a second guide member.

23. The inductor of claim 22, wherein said first guide member is formed as a through-hole in said first portion of said flange, and said second guide member is formed as a substantially U-shaped groove in said second portion of said flange.

24. The inductor of claim 15, further comprising a tuning member positioned within said inner cavity of said mandrel.

25. An electronic filter comprising at least one tunable inductor, said tunable inductor comprising:

an elongate mandrel having a central axis, a first end, an opposed second end, an outer surface and an inner surface defining an inner cavity, and having a helical groove of predetermined pitch formed on said outer surface and extending in a direction from said first end toward said second end;

a wire having a diameter, a first end and a second end, said wire being positioned within, said helical groove of said mandrel and wound about said central axis of said mandrel;

a turn member protruding from said outer surface of said mandrel for redirecting said wire from said helical groove toward said first end of said mandrel in a direction substantially parallel to said outer surface of said mandrel; and a flange proximate said first end of said mandrel and positioned substantially perpendicular to said central axis of said mandrel, said flange having at least one guide member, wherein said turn member is spaced a distance from said flange in the axial direction of said mandrel.

26. An electronic filter comprising at least one tunable inductor, said tunable inductor comprising:

an elongate mandrel having a central axis, a first end, an opposed second end, an outer surface and an inner surface defining an inner cavity, and having a helical groove of predetermined pitch formed on said outer surface and extending in a direction from said first end toward said second end;

a wire having a diameter, a first end and a second end, said wire being positioned within said helical groove of said mandrel and wound about said central axis of said mandrel;

a turn member protruding from said outer surface of said mandrel for redirecting said wire from said helical groove toward said first end of said mandrel in a direction substantially parallel to said outer surface of said mandrel; and a flange proximate said first end of said mandrel and positioned substantially perpendicular to said central axis of said mandrel, said flange having at least one guide member, wherein said turn member is radially offset from one of said at least one guide member by an amount substantially equal to said diameter of said wire.

27. The electronic filter of claim 25, wherein said helical groove of said at least one inductor begins at a position proximate said first end of said mandrel and extends toward said second end over a predetermined distance along said central axis.

28. The electronic filter of claim 25, further comprising at least one anti-rotation member having a predetermined shape proximate said first end of said mandrel and positioned beneath said flange.

29. The electronic filter of claim 28, wherein said filter further comprises a circuit board having a first surface, a second surface, and at least one opening passing from said first surface to said second surface thereof, said opening being shaped to compliment said predetermined shape of said anti-rotation member to prevent said inductor from rotating with respect to said circuit board.

30. The electronic filter of claim 29, wherein said flange is positioned proximate said first surface of said circuit board.

31. A tunable inductor comprising:

an elongate mandrel having a central axis, a first end, an opposed second end, an outer surface and an inner surface defining an inner cavity;

a flange proximate said first end of said mandrel and positioned substantially perpendicular to said central axis of said mandrel;

a wire having a diameter, a first end and a second end, said wire being wound about said outer surface of said mandrel from a position proximate said first end of said mandrel toward said second end of said mandrel;

a turn member positioned a distance from said flange in the axial direction of said mandrel and protruding from said outer surface of said mandrel, wherein said turn member redirects said wire in a direction substantially parallel to said outer surface of said mandrel back toward said first end of said mandrel; and means for maintaining the position of said wire with respect to said mandrel.

32. The inductor of claim 31, further comprising at least one guide member positioned in a portion of said flange, wherein said turn member is radially offset from one of said at least one guide member by an amount substantially equal to said diameter of said wire.

33. The inductor of claim 31, wherein said means for maintain in the position of said wire with respect to said mandrel comprises at least one layer of an electrically insulating material covering substantially all of said wire wound about said mandrel.

34. The inductor of claim 33, wherein said means for maintaining the position of said wire with respect to said mandrel further comprises a second layer of an electrically insulating material covering said first layer and that portion of said wire being redirected from said turn member in a direction substantially parallel to said outer surface of said mandrel back toward said first end of said mandrel.

35. The inductor of claim 31, wherein said wire is coated with an insulating material.

36. The inductor of claim 35, wherein said means for maintaining the position of said wire with respect to said mandrel comprises at least one layer of an electrically insulating material substantially surrounding substantially all of said outer surface of said mandrel, including the entire portion thereof over which said wire is wound and including the portion of said wire being redirected from said turn member in a direction substantially parallel to said outer surface of said mandrel back toward said first end of said mandrel.

37. A tunable inductor comprising:

an elongate mandrel extending in a first direction from a first end toward an opposed second end and having a central axis, an outer surface and an inner surface defining an inner cavity;

a flange proximate said first end of said mandrel and positioned substantially perpendicular to said central axis of said mandrel, said flange having a first surface and an opposed second surface adapted to rest on a surface of a circuit board;

an extension member extending beyond said flange in a second direction substantially opposite to said first direction, said extension member having an outer surface and an inner surface that is substantially contiguous with said inner surface of said mandrel to define an extension of said inner cavity of said mandrel;

a wire having a diameter, a first end and a second end, said wire being wound about said outer surface of said mandrel from a position proximate said first end of said mandrel toward said second end of said mandrel; and a tuning member having an initial position located within the inner cavity of said extension beyond a flux field created by said wire wound on said mandrel, such that said tuning member in said initial position does not substantially affect the inductance of the inductor.

38. The inductor of claim 37, further comprising at least one anti-rotation member positioned on said outer surface of said extension member.

39. The inductor of claim 37, further comprising means for maintaining the position of said wire with respect to said mandrel.

40. The inductor of claim 37, wherein said tuning member does not substantially extend beyond said flange.

41. The inductor of claim 37, further comprising a turn member positioned a distance from said flange in the first direction and protruding from said outer surface of said mandrel, wherein said turn member redirects said wire in said second direction such that said redirected wire extends substantially parallel to said outer surface back toward said first end of said mandrel;

42. The inductor of claim 41, further comprising a first guide member positioned in a first portion of said flange, wherein said turn member is radially offset from said first guide member by an amount substantially equal to said diameter of said wire.

43. The inductor of claim 42, further comprising a second guide member positioned in a second portion of said flange substantially opposing said first portion.

44. The inductor of claim 37, wherein said flange further comprises first and second guide members for receiving portions of said wire proximate said first and second ends of said wire, and at least one stepped portion positioned proximate each of said first and said second guide members on said second surface, said at least one stepped portion being dimensioned to receive a portion of said wire extending through a respective one of said first and said second guide members such that said wire does not extend from said at least one stepped portion beyond the plane of said second surface of said flange.

45. The inductor of claim 44, wherein said at least one stepped portion positioned proximate said first guide member redirects said wire in a third direction substantially perpendicular to said central axis of said mandrel, and said at least one stepped portion positioned proximate said second guide member redirects said wire in a fourth direction substantially perpendicular to said central axis of said mandrel and substantially opposing said third direction.

46. The electronic filter of claim 26, wherein said helical groove of said at least one inductor begins at a position proximate said first end of said mandrel and extends toward said second end over a predetermined distance along said central axis.

47. The electronic filter of claim 26, further comprising at least one anti-rotation member having a predetermined shape proximate said first end of said mandrel and positioned beneath said flange.

48. The electronic filter of claim 47, wherein said filter further comprises a circuit board having a first surface, a second surface, and at least one opening passing from said first surface to said second surface thereon, said opening being shaped to compliment said predetermined shape of said anti-rotation member to prevent said inductor from rotating with respect to said circuit board.

49. The electronic filter of claim 48, wherein said flange is positioned proximate said first surface of said circuit board.

* * * * *